United States Patent [19]

Summers et al.

[11] 4,119,160

[45] Oct. 10, 1978

[54] METHOD AND APPARATUS FOR WATER JET DRILLING OF ROCK

[75] Inventors: David A. Summers, Rolla, Mo.; Marian Mazurkiewicz, Wroclaw, Poland; Dwight J. Bushnell, Corvallis, Oreg.; James Blaine, Rolla, Mo.

[73] Assignee: The Curators of the University of Missouri, Columbia, Mo.

[21] Appl. No.: 763,926

[22] Filed: Jan. 31, 1977

[51] Int. Cl.[2] ..... E21B 7/18

[52] U.S. Cl. ..... 175/67; 175/422; 239/548

[58] Field of Search ..... 175/67, 422, 15; 239/548, 561; 299/17

[56] References Cited

U.S. PATENT DOCUMENTS

| | | | |
|---|---|---|---|
| 1,661,672 | 3/1928 | Morrison | 175/67 X |
| 2,783,972 | 3/1951 | Fehlmann | 175/67 X |
| 2,785,875 | 3/1957 | Hayes | 175/67 X |
| 3,081,828 | 3/1963 | Quick | 175/67 |
| 3,360,057 | 12/1967 | Anderson | 175/67 |
| 3,536,151 | 10/1970 | Aarup | 175/422 |
| 3,576,222 | 4/1971 | Acheson et al. | 175/67 |
| 3,924,698 | 12/1975 | Juvkam-Wold | 175/422 X |
| 3,927,723 | 12/1975 | Hall et al. | 175/67 X |
| 3,960,407 | 6/1976 | Noren | 299/17 |

FOREIGN PATENT DOCUMENTS

| | | | |
|---|---|---|---|
| 1,484,520 | 9/1969 | Fed. Rep. of Germany | 175/67 |

OTHER PUBLICATIONS

Novel Drilling Techniques, William C. Maurer, Pergamon Press, NY., Mar. 1968, pp. 39–44.

*Primary Examiner*—Ernest R. Purser
*Assistant Examiner*—Richard E. Favreau
*Attorney, Agent, or Firm*—Ray E. Snyder

[57] ABSTRACT

Rock drilling method and apparatus utilizing high pressure water jets for drilling holes of relatively small diameter at speeds significantly greater than that attainable with existing drilling tools. Greatly increased drilling rates are attained due to jet nozzle geometry and speed of rotation. The jet nozzle design has two orifices, one pointing axially ahead in the direction of travel and the second inclined at an angle of approximately 30° from the axis. The two orifices have diameters in the ratio of approximately 1:2. Liquid jet velocities in excess of 1,000 ft/sec are used, and the nozzle is rotated at speeds up to 1,000 rpm and higher.

4 Claims, 8 Drawing Figures

VARIATION IN HOLE DIAMETER WITH FEED RATE IN THE FORM $Y = A\chi^B$

HOLE DIAMETER FOR TWO NOZZLES AND TWO ROTATION SPEEDS AS A FUNCTION OF ADVANCE RATE

BOREHOLE & CONFINING PRESSURE EFFECTS ON HOLE DIAMETER

METHOD AND APPARATUS FOR WATER JET DRILLING OF ROCK

BACKGROUND OF THE INVENTION

The invention described herein was made in part in the course of work under a grant or award from the United States Energy Research and Development Administration.

1. Field of the Invention

This invention relates generally to the field of Boring or Penetrating the Earth, and more particularly to method and apparatus for boring by fluid erosion.

2. Description of the Prior Art

The drilling of holes of relatively small diameter (e.g. 1–7 inches) in rock is commonplace in mining, tunneling and quarrying operations. One common application is the location of roof bolt holes in the overlying strata above mine openings. Such holes are most commonly-drilled by a drag bit type of device or by a pneumatic hammer driven chisel bit. Similarly, holes are driven in mining and tunneling operations for the emplacement of explosives and such holes are also drilled by mechanical type bit or impacting chisel bit. In the drilling of oil wells, water jets frequently are added as a supplement to roller cone drilling bits.

Hydraulic jet drilling of rock has been described in the patent art, as exemplified by the patent to Acheson, U.S. Pat. No. 3,567,222. Acheson teaches a freely rotating jet drill bit having a plurality of jet nozzles which discharge a drilling liquid carrying suspended abrasive particles. The drill bit is caused to rotate by the reaction force of the fluid ejected.

In practice, the drilling rate of small diameter holes through rock is restricted with existing mechanical drilling systems because of the limiting thrust that can be carried through the small diameter drill rod to the drilling bit. The use of water jets as an assist to roller cone bits still requires a large thrust to be carried in the drill stem, and there are problems with the reliability of such systems. Large pumping devices are required, very large flow rates, and the jet cutting fluid is generally a drilling mud, which does not cut as effectively as a water jet alone.

The use of abrasives suspended in the drilling liquid introduces some additional problems. Such abrasives, if effective to cut rock, are also sufficient to cause rapid wear on the orifice surface of the drilling nozzles. In addition, the presence of such particles creates problems in the pumping and circulating in a drilling system.

SUMMARY OF THE INVENTION

This invention utilizes a water jet nozzle as a drill bit having a configuration of two jet orifices, specifically of different diameters, one directed axially along the direction of travel of the drill head, and the other inclined at the angle to the axis of rotation. The drilling nozzle is welded to a steel feed pipe which is itself rotatably mounted on an extensible boom which can feed the drill nozzle and pipe into the hole as it is drilled. Drilling liquid velocities of at least 1,000 ft/sec are used, and the drill head is rotated in the hole at a rate normally in the range of 1,000 to 1,500 rpm, cutting therefore the rock forming the bottom of the borehole.

The invention provides a more rapid method of drilling through rock than previously available and thereby predicts a reduction in cost and energy consumption in performing such operation. Because the nozzle does not come into contact with the rock, there is an increase in the life of the nozzle bits to a level much greater than that currently attained.

DETAILED DESCRIPTION OF THE PREFERRED EMBODIMENT

The significantly improved performance of the present invention can best be described in terms of the experimental procedures leading to its discovery.

The basic objective of the underlying investigation was to study the feasibility of high pressure water jet drilling as an alternative to conventional drilling systems for geothermal exploration. Conventional drilling to very deep depths becomes exponentially expensive.

Berea sandstone was selected for use in the initial experiments because it is a standard rock and relatively soft so that any variation in drilling due to changes in test conditions could be easily discerned. Subsequent experiments have included Indiana limestone, Tennessee marble, and Missouri granite.

In establishing criteria for measuring drilling performance, it was a major objective to effect a faster drilling rate particularly in harder rock materials. Because of the irregularity of holes drilled by a water jet, and the number of variables in experimental conditions, it was determined to relate hole diameter and advance rate and then use hole diameter as the test parameter.

Figure 1:
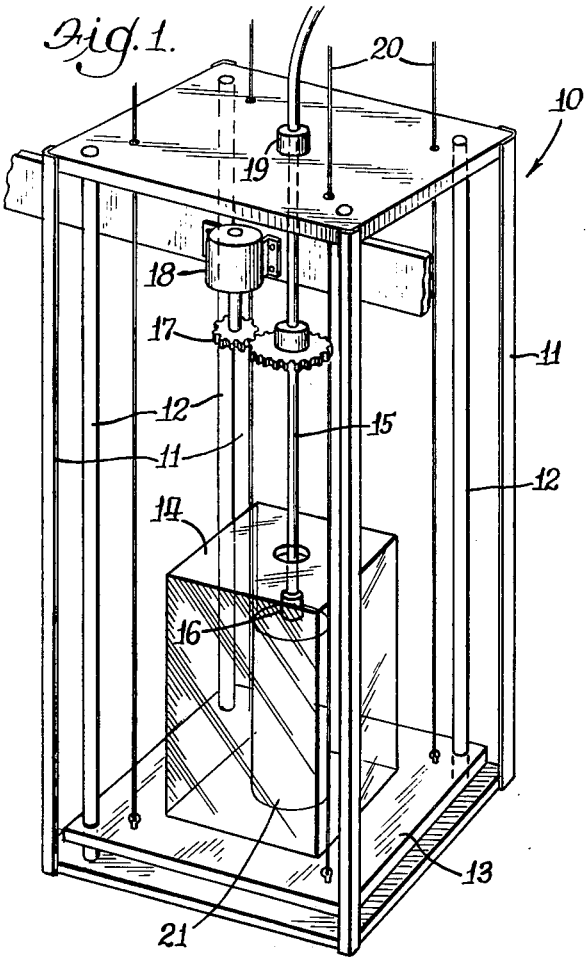
FIG. 1 is a schematic diagram of experimental apparatus used to measure jet nozzle drilling performance.

The experimental apparatus for conducting the investigation is shown schematically in FIG. 1. The test rig is designated generally by the numeral 10 and comprises: a rectangular upright framework 11 having four vertical guide rails 12, a vertically movable platform 13, a sample retaining housing 14, a vertical drill stem 15, a jet nozzle 16, a drive gear train 17, and motor 18. The drill stem 15 is connected through a high pressure coupling 19 to a source of high pressure fluid (not shown). The motor 18 and gear train 17 are mounted on the frame 11 and are connected to the drill stem 15 for rotating it about a vertical axis. The platform 13 is caused to be raised or lowered as required by means of a plurality of cables 20 attached to a suitable hoist mechanism (not shown). The advance rate of the nozzle 16 into a rock sample 21 is controlled by the speed at which the sample is raised by the platform 13 relative to the fixed horizontal position of the nozzle 16.

Figure 3:
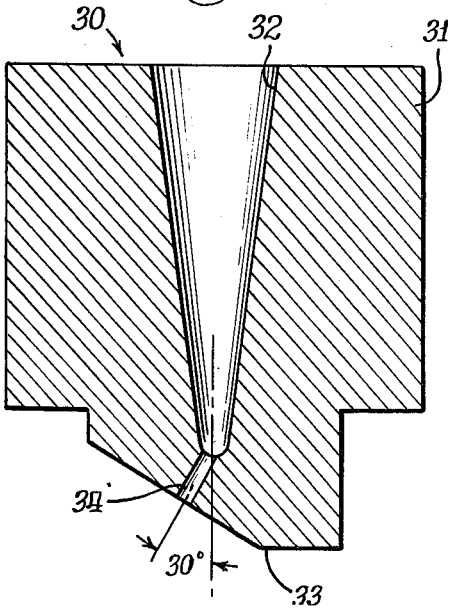
FIG. 3 is an enlarged sectional view of an experimental jet nozzle used to perform the drilling of FIG. 2.

Initial drilling experiments were conducted using the apparatus of FIG. 1 and a single jet nozzle of the type shown in FIG. 3. The nozzle of FIG. 3 is designated generally by the numeral 30 and comprises a generally cylindrical body 31 formed with an internal central cavity 32, a tip 33, and an orifice 34 having a diameter of 0.04 in. The orifice 34 is inclined at an angle of about 30° with the axis of the nozzle body 31. A fluid ejection pressure of 10,000 psi was used for discharging water through the orifice 34. The drill stem 15 and nozzle 30 was rotated at speeds of 40, 80, and 120 rpm, and the platform 13 was raised at a speed of about 2 in. per minute.

Figure 2:
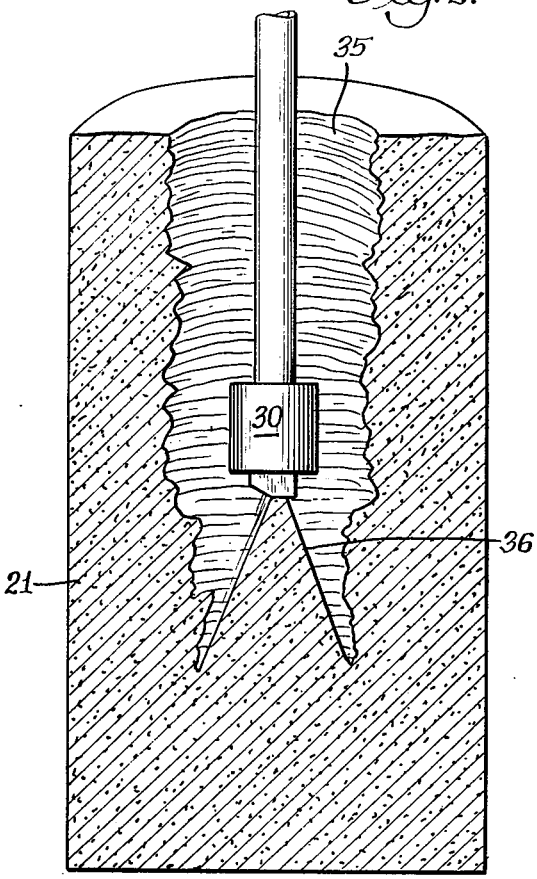
FIG. 2 is a longitudinal sectional view of a rock sample laid open to show how the high pressure water jet drilling is performed.

The rotating water jet stream discharged by the nozzle 30 cut a rough cylindrical channel 35 through the sample 21, as shown in FIG. 2. The orientation of the jet stream also produced a central cone 36 in front of the direction of travel. The drilling experiments were interrupted in several instances when the nozzle tip 33 contacted the cone 36. Such contact caused rapid erosion of the nozzle tip 33.

Figure 4:
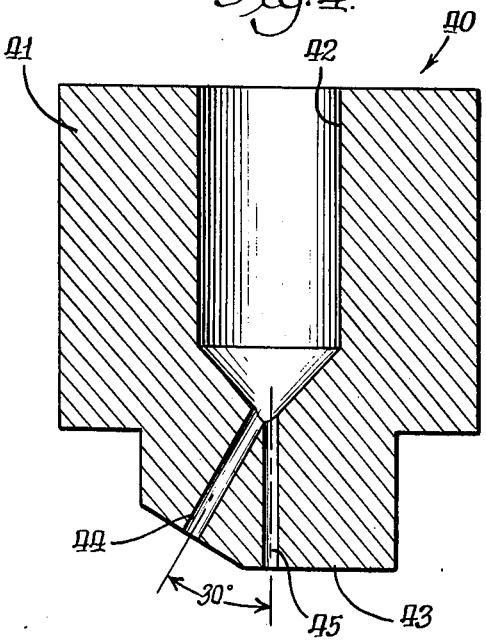
FIG. 4 is an enlarged sectional view of the improved jet drilling nozzle of the present invention.

To prevent such direct contact with the central cone 36, a small axial orifice, 0.02 in. in diameter was drilled through the center of the nozzle body 31 to produce a nozzle of the type shown in FIG. 4. The result was a dramatic increase in the diameter of the hole 35 achieved which translated into an ability to drill the Berea sandstone sample 21 at a rate of 15 in./min. At a traverse rate of 2 in./min. the addition of this 25% flow rate increased the volume of rock removed by 750%.

This led to a comparative study to determine if increasing the size of the central orifice, while retaining the same size for the angled orifice would be advantageous. In the event this did not work as well. This was because the flow was preferentially now going straight ahead of the nozzle rather than flowing through the angular orifice.

Futher curiosity of the effects of nozzle geometry led to the investigation of more than 20 nozzles having multiple orifices and varying configurations. Test results with such nozzles confirmed the superiority of the two jet nozzle of FIG. 4.

The preferred nozzle of FIG. 4 is designated generally by the numeral 40 and comprises a cylindrical body 41, a central cavity 42, tip 43, angular reaming orifice 44, and a central axial orifice 45. The axis of the reaming orifice 44 is inclined at about 30° with the axis of the body 41. The preferred diameter of the axial orifice 45 is 0.03 in. and that of the reaming orifice 44 is 0.06 in. In using the nozzle 40, a drilling rate has been achieved of 42 in./min., some 2100% greater than that of a single orifice of 0.04 in. diameter, with an increase of less than 300% in flow volume.

Figure 5:
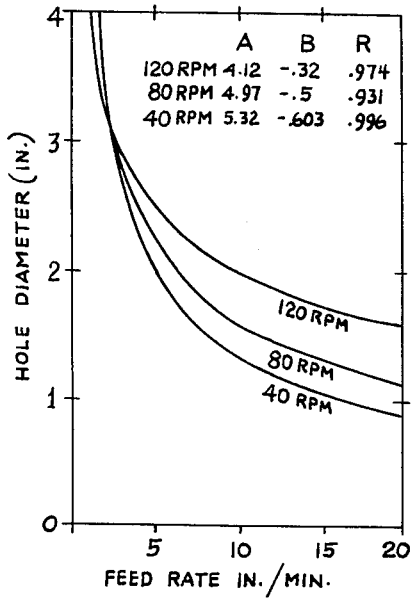
FIG. 5 is a graph showing the variation in bore hole diameter as a function of feed rate for differing speeds of rotation.

The terms "advance rate" and borehole "diameter" need to be clarified in connection with water jet drilling. The rotating water jet stream cuts a helical path as it advances through the sample. Depending on the speed of advance, the path cut may leave ribs of rock between successive rotations which may interfere with nozzle advance. It also makes definition of the hole diameter difficult. In addition, the rock structure is usually anisotropic which has the effect that the hole as drilled is not necessarily round. It has been found that relating the speed of rotation of the nozzle and the advance rate can significantly improve the quality of the hole bored. A mathematical relationship between advance rate and hole diameter is illustrated in the graph of FIG. 5, with an intersection at an advance rate of 2 in./min. for the speeds of rotation selected. This point is the advance rate which had been used in preliminary testing and had led to the erroneous conclusions that hole diameter was not feed rate dependent.

Figure 6:
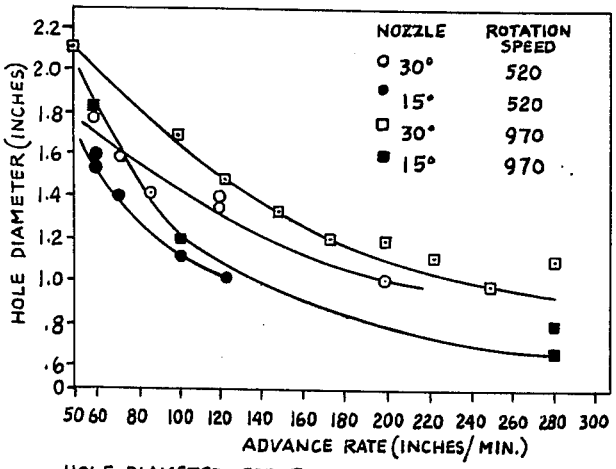
FIG. 6 is a graph showing the variation in bore hole diameter as a function of feed rate for differing angular separations of the nozzle jets.

Increasing the rotational speed has had a remarkable effect on the advance rate. It has been found that by using rotational speeds of up to 1,000 rpm, advance rates of up to 280 in./min. can be attained in the Berea sandstone samples. The experimental data obtained for higher rotational speeds are illustrated in the graph of FIG. 6. This graph also illustrates the comparative results of borehole diameter as a function of advance rate for differing angles of inclination of the reaming orifice 44. The results illustrated indicate that there is a substantial range of variabiility of rotational speeds and angularity of the two orificies that may still produce acceptable performance.

Figure 7:
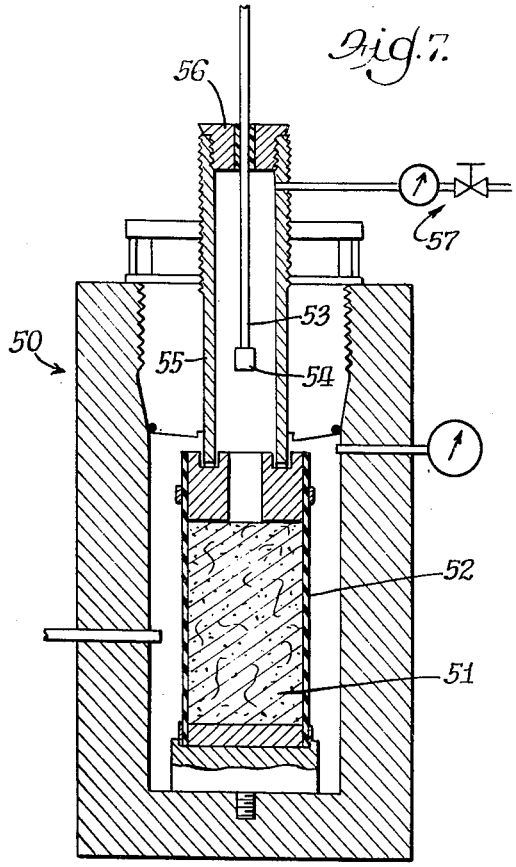
FIG. 7 is a schematic sectional view of a modified triaxial pressure vessel used to simulate drilling at deep depths in the earth.

In order to simulate drilling conditions deep in the earth, the experimental apparatus of FIG. 1 was modified to include a triaxial pressure vessel in place of the sample retaining housing 14. This vessel 50 is shown in sectional schematic form in FIG. 7. A rock specimen 51 is contained within a rubber jacket 52 and subjected to confining pressures up to 6,000 psi by means of hydraulic fluid pressure introduced into the interior of the vessel 50. A high pressure jet drill stem 53 and nozzle 54 are moved axially through a pressure confining sleeve 55 and teflon sealing cap 56 into an operable position next to the rock specimen 51. The drilling water introduced under high pressure through the nozzle 54 is confined within the sleeve 55 by means of a back pressure controller 57. This permits the simulation of the back pressure developed by a tall column of liquid above a drilling site. The increased mass of the system including the pressure vessel 50 limited the experimental advance rate to 40 in./min.

Figure 8:
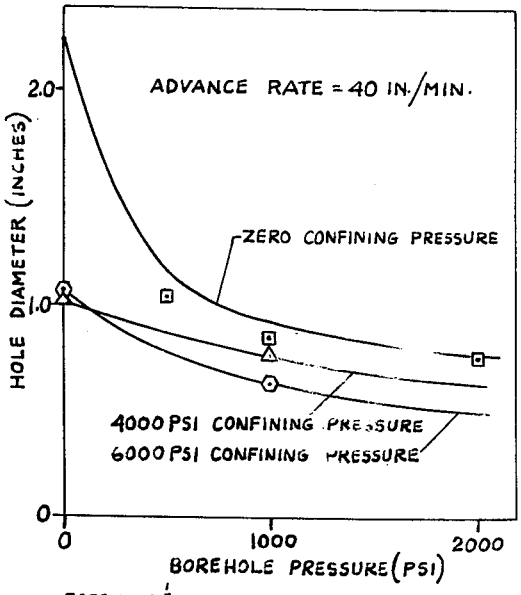
FIG. 8 is a graph showing the variation in bore hole diameter as a function of bore hole pressure.

The test results using the triaxial pressure vessel 50 are plotted on the graph of FIG. 8. The curves show that the application of any pressure to the rock/jetting system sharply reduced the cutting ability of the jets. This effect occurred both with the creation of a back pressure and with the confinement of the rock. However, once the initial restriction of the rock had been imposed, a further increase in confining pressure appeared to have little effect. Similarly while a back pressure of 500 psi over the nozzle lowered the jet cutting diameter by almost 100%, a further increase in back pressure of 1,500 psi lowered the cutting diameter by only 25%. There is, therefore, an apparent change occurring in the jet cutting operation at relatively low levels of applied pressure which, if understood, might lead to greater penetration rates for the system.

Further experiments showed that a reduction in the high pressure source for jetting from 10,000 to 5,000 psi did not produce as great a reduction as that of the 500 psi increase in back pressure. This ruled out the simple pressure drop across the nozzle as the sole controlling parameter. Creation of a rock confining pressure also reduced jet penetration, however additional increase in pressure had little further effect.

Additional experiments on harder rock specimens have shown that the uniaxial compressive strength of the rock is not an adequate measure of its cuttability by water jets. For example, in a modified experimental system at an advance rate of 15 in./min. at 970 rpm at 25,000 psi, a jet cut a hole 1.06 in. in diameter in Missouri red granite (compressive strength 27,200 psi), but only 0.72 in. in diameter in Tennessee marble (compressive strength 17,100 psi).

Similarly the same jet system cut a cavity 2.35 in. in diameter in Berea sandstone (compressive strength 7,500 psi), while a diameter of 1.28 in. was cut in Indiana limestone (compressive strength 6,400 psi). However, it should be noted, both these rocks are anisotropic and the strength and cuttability are a function of the direction of drilling.

The effects of the addition of low concentrations of several commercial brands of long chain polymers to the jet liquid were also investigated. In systems using fine jet streams for cutting paper, plastics, and other relatively soft materials, the addition of such polymers have been found useful to improve jet stream cohesion beyond the nozzle. Such requirements are not present in jet drilling, and some spreading of the stream might be desirable. Nonetheless, the results indicated very little differentiation between the polymers selected, but they all appeared to improve penetration by approximately 15%. Increasing the polymer concentration above 700 ppm showed no improvement.

The embodiment shown and described incorporated a rotational drive mechanism for driving and controlling the speed of rotation of the nozzle. This was desired for the experimental work. It is possible to modify the preferred embodiment to make it self rotating. This can be accomplished by off-setting and tilting the angular jet from the rotational axis of the nozzle. The nozzle can then be caused to rotate by the reaction force of the fluid ejected. The speed of rotation of such a design could be controlled by the degree of tilt, the amount of off-set from the axis, and the pressure used for drilling. The first two would be fixed for a particular drilling run, the pressure could be controlled within some range as required for the particular drilling conditions.

Water jets in drilling have an advantage over conventional drilling tools in that the pressure is hydrostatic, and the jets can be directed at any required angle from the drilling axis and still effectively cut rock. This principal is employed to advantage for drilling small holes in mining — particularly for roof bolt emplacement. It is also possible to control the geometry of the hole drilled to some degree. For example, it is possible to drill a relatively small entry hole into a rock by using a fast speed of advance, and then enlarge the interior by using a slower advance rate and perhaps a higher speed of rotation. Such a bottle-shaped internal geometry may be desired for the emplacement of explosives.

The experimental data compiled have clearly demonstrated the superiority of the preferred embodiment of the invention over existing drilling systems. Depending on the material being drilled, the improvement may be a factor of 10 or more over existing systems. Other modified embodiments of the invention might also be useful for particular applications. One form of nozzle geometry that was investigated included two forward pointing jets in place of the single axial jet 45. The two jets were inclined to intersect within the block and were found to result in splitting the test sample in half after 10 sec. The experiment was repeated with the bedding in the perpendicular direction, and the sample again split along the bedding plane. The indications are, therefore, that a dual jet directed ahead of the main reaming jet might be advantageous in giving better hole cutting and perhaps breaking of the rock. Improved performance still requires that the size of the dual nozzle be less than that of the reaming orifice.

The invention is not to be considered as limited to the embodiments shown and described, except in-so-far as the claims may be so limited.

We claim:

1. Energy efficient rock drilling apparatus utilizing a high pressure liquid source to generate high velocity jet streams for drilling by direct contact of the jet streams against rock comprising:

means defining a drill stem having a drilling axis concentric with said drill stem;

means for rotating said drill stem about said axis;

a liquid jet nozzle attached to the free end of said drill stem and connected hydraulically to the high pressure liquid source;

said jet nozzle being formed with only two liquid exit orifices directed to form jet streams that cooperatively interact for drilling through rock with a first orifice being directed along said drilling axis and a second orifice inclined at an angle with respect to said drilling axis, and with the respective diameters of said first and second orifices being in the approximate ratio of 1:2.

2. The rock drilling apparatus of claim 1 wherein:

the angle of inclination of the second orifice with respect to said drilling axis is in the approximate range of 15° to 30°.

3. The rock drilling apparatus of claim 1 including:

means for advancing said nozzle along said drilling axis with respect to the rock being drilled.

4. An energy efficient method of drilling rock by utilizing a high pressure source for generating high velocity water jet streams which are ejected from a nozzle and directed against rock to be drilled along predetermined drilling axis comprising the steps of:

providing a drilling nozzle connected to the high pressure source and formed with two jet orifices with a first orifice being directed along the drilling axis and a second orifice being directed forwardly at an acute angle with respect to said first orifice and with the diameters of the respective orifices being in the approximate ratio of 1:2;

pressurizing the source so as to provide a water jet velocity from said orifices in excess of 1000 ft/sec; and rotating said nozzle about said drilling axis at rotational speeds of approximately 1000 rpm.

* * * * *